United States Patent [19]

Reinert

[11] Patent Number: 5,030,243

[45] Date of Patent: Jul. 9, 1991

[54] PROCESS FOR THE PHOTOCHEMICAL STABILIZATION OF UNDYED AND DYEABLE ARTIFICIAL LEATHER WITH A STERICALLY HINDERED AMINE

[75] Inventor: Gerhard Reinert, Allschwil, Switzerland

[73] Assignee: Ciba-Giegy Corporation, Ardsley, N.Y.

[21] Appl. No.: 457,454

[22] Filed: Dec. 27, 1989

[30] Foreign Application Priority Data

Jan. 5, 1989 [CH] Switzerland ..... 31/89

[51] Int. Cl.[5] ..... D06P 5/02; D06N 3/00

[52] U.S. Cl. ..... 8/490; 8/436; 8/442; 8/515; 8/516; 8/531; 8/568

[58] Field of Search ..... 8/115.59, 490, 531, 8/568, 442

[56] References Cited

U.S. PATENT DOCUMENTS

| | | | |
|---|---|---|---|
| 3,640,928 | 2/1972 | Murayama et al. | 524/102 |
| 3,840,494 | 10/1974 | Murayama et al. | 524/102 |
| 3,850,877 | 11/1974 | Cook | 524/102 |
| 3,920,661 | 11/1975 | Ramey et al. | 524/102 |
| 3,993,655 | 11/1976 | Rasberger et al. | 546/188 |
| 3,998,784 | 12/1976 | Cook | 524/102 |
| 4,812,139 | 3/1989 | Brodmann | 8/490 |
| 4,874,391 | 10/1989 | Reinert | 8/442 |

FOREIGN PATENT DOCUMENTS

58/163785 9/1983 Japan .

*Primary Examiner*—A. Lionel Clingman
*Attorney, Agent, or Firm*—Edward McC. Roberts

[57] ABSTRACT

There is disclosed a process for the photochemical stabilization of undyed and dyeable artificial leather, which comprises treating said artificial leather in an aqueous liquor which contains a light stabilizer. A composition for carrying out the process is also described.

15 Claims, No Drawings

PROCESS FOR THE PHOTOCHEMICAL STABILIZATION OF UNDYED AND DYEABLE ARTIFICIAL LEATHER WITH A STERICALLY HINDERED AMINE

The present invention relates to a process for the photochemical stabilisation of undyed and dyeable artificial leather, to a composition for carrying out said process, and to the artificial leather treated therewith.

High-quality synthetic leather derived from polyurethane/polyamide and dyeings obtained on these substrates suffer damage from exposure to light, especially when accompanied by simultaneous heat radiation. Hence the photochemical stabilisation of artificial leather which is dyed with selected dyes is insufficient for numerous utilities, for example for automobile interiors.

There has therefore been no lack of attempts to protect artificial leather and the dyeings produced thereon from the effects of light and heat with the aid of UV absorbers. In these known methods, the light stabilisers are incorporated in organic solutions of the polymer components of the synthetic leather or are applied as protective layer, together with an organic solvent, to the leather. Light-stable artificial leather which is coated with a UV absorber dissolved in an organic solvent is disclosed, for example, in JP 58/163 785.

It has now been found that undyed and dyeable artificial leather can also be stabilised from aqueous liquors.

The process of this invention comprises treating the undyed or dyeable artificial leather in an aqueous liquor which contains a light stabiliser.

The light stabiliser preferably used in the process of this invention is a sterically hindered amine which contains in the molecule at least one group of formula I

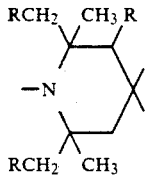

(I)

wherein R is hydrogen or methyl.

Such light stabilisers may be of low molecular weight (<700) or of high molecular weight (oligomers, polymers). These groups preferably carry one or two polar substituents in 4-position or a polar spiro ring system is in 4-position.

Particularly interesting sterically hindered amines are those of formula II

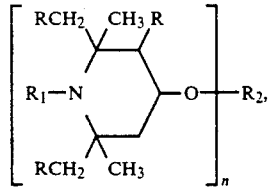

(II)

wherein n is an integer from 1 to 4, preferably 1 or 2, R is hydrogen or methyl, $R_1$ is hydrogen, hydroxy, $C_1$–$C_{12}$alkyl, $C_3$–$C_8$alkenyl, $C_3$–$C_8$alkynyl, $C_7$–$C_{12}$aralkyl, $C_1$–$C_8$alkanoyl, $C_3$–$C_5$alkenoyl, glycidyl, —O—$C_1$–$C_{12}$alkyl, O—$C_1$–$C_8$alkanoyl or a group —$CH_2CH(OH)$—Z, wherein Z is hydrogen, methyl or phenyl, $R_1$ preferably being hydrogen, $C_1$–$C_4$alkyl, allyl, benzyl, acetyl or acryloyl, and $R_2$, when n is 1, is hydrogen, $C_1$–$C_{18}$alkyl which may be interrupted in the chain by one or more oxygen atoms, or is cyanoethyl, benzyl, glycidyl, a monovalent radical of an aliphatic, cycloaliphatic, araliphatic, unsaturated or aromatic carboxylic acid, carbamic acid or phosphorus-containing acid, or is a monovalent silyl radical, preferably a radical of an aliphatic carboxylic acid of 2 to 18 carbon atoms, of a cycloaliphatic carboxylic acid of 7 to 15 carbon atoms, of an $\alpha,\beta$-unsaturated carboxylic acid of 3 to 5 carbon atoms or of an aromatic carboxylic acid of 7 to 15 carbon atoms, or, when n is 2, is $C_1$–$C_{12}$alkylene, $C_4$–$C_{12}$alkenylene, xylylene, a divalent radical of an aliphatic, cycloaliphatic, araliphatic or aromatic dicarboxylic acid, dicarbamic acid or phosphorus-containing acid, or is a divalent silyl radical, preferably a radical of an aliphatic dicarboxylic acid of 2 to 36 carbon atoms, of a cycloaliphatic or aromatic dicarboxylic acid of 8 to 14 carbon atoms, or of an aliphatic, cycloaliphatic or aromatic dicarbamic acid of 8 to 14 carbon atoms, or, when n is 3, is a trivalent radical of an aliphatic, cycloaliphatic or aromatic tricarboxylic acid, of an aromatic tricarbamic acid or of a phosphorus-containing acid, or is a trivalent silyl radical or, when n is 4, is a tetravalent radical of an aliphatic, cycloaliphatic or aromatic tetracarboxylic acid.

Substituents defined as $C_1$–$C_{12}$alkyl are typically methyl, ethyl, n-propyl, n-butyl, sec-butyl, tert-butyl, n-hexyl, n-octyl, 2-ethylhexyl, n-nonyl, n-decyl, n-undecyl or n-dodecyl.

$R_1$ and $R_2$ as $C_1$–$C_{18}$alkyl may be one of the above mentioned groups and, in addition, may be n-tridecyl, n-tetradecyl, n-hexadecyl or n-octadecyl.

$R_1$ as $C_3$–$C_8$alkenyl may be 1-propenyl, allyl, methallyl, 2-butenyl, 2-pentenyl, 2-hexenyl, 2-octenyl, or 4-tert-butyl-2-butenyl.

$R_1$ as $C_3$–$C_8$alkynyl is preferably propargyl.

$R_1$ as $C_7$–$C_{12}$aralkyl is preferably phenethyl or, most preferably, benzyl.

$R_1$ as $C_1$–$C_8$alkanoyl may be formyl, propionyl, butyryl, octanoyl, but is preferably acetyl, and, as $C_3$–$C_5$alkenoyl, $R_1$ is preferably acryloyl.

$R_2$ as a monovalent radical of a carboxylic acid may be the radical of acetic acid, capronic acid, stearic acid, acrylic acid, methacrylic acid, benzoic acid or $\beta$-(3,5-di-tert-butyl-4-hydroxyphenyl)propionic acid.

$R_2$ as a divalent radical of a dicarboxylic acid may be the radical of malonic acid, succinic acid, glutaric acid, adipic acid, suberic acid, sebacic acid, maleic acid, phthalic acid, dibutylmalonic acid, dibenzylmalonic acid, butyl-(3,5-di-tert-butyl-4-benzyl)malonic acid or bicycloheptenedicarboxylic acid.

$R_2$ as a trivalent radical of a tricarboxylic acid may be the radical of trimellitic acid or nitrilotriacetic acid.

$R_2$ as a tetravalent radical of a tetracarboxylic acid may be the tetravalent radical of butane-1,2,3,4-tetracarboxylic acid or of pyromellitic acid.

$R_2$ as a divalent radical of a dicarbamic acid may be the radical of hexamethylenedicarbamic acid or of 2,4-toluylenedicarbamic acid.

Illustrative of polyalkylpiperidine compounds of this class are the following compounds:

(1) 4-hydroxy-2,2,6,6-tetramethylpiperidine
(2) 1-allyl-4-hydroxy-2,2,6,6-tetramethylpiperidine
(3) 1-benzyl-4-hydroxy-2,2,6,6-tetramethylpiperidine (4) 1-(4-tert-butyl-2-butenyl)-4-hydroxy-2,2,6,6-tetramethylpiperidine
(5) 4-stearoyloxy-2,2,6,6-tetramethylpiperidine
(6) 1-ethyl-4-salicyloyloxy-2,2,6,6-tetramethylpiperidine
(7) 4-methacryloyloxy-1,2,2,6,6-pentamethylpiperidine
(8) 1,2,2,6,6-pentamethylpiperidin-4-yl-β-(3,5-di-tert-butyl-4-hydroxy-phenyl)propionate
(9) bis(1-benzyl-2,2,6,6-tetramethylpiperidin-4-yl)maleate
(10) bis(2,2,6,6-tetramethylpiperidin-4-yl)succinate
(11) bis(2,2,6,6-tetramethylpiperidin-4-yl)glutarate
(12) bis(2,2,6,6-tetramethylpiperidin-4-yl)adipate
(13) bis(2,2,6,6-tetramethylpiperidin-4-yl)sebacate
(14) bis(1,2,2,6,6-pentamethylpiperidin-4-yl)sebacate
(15) bis(1,2,3,6-tetramethyl-2,6-diethylpiperidin-4-yl)sebacate
(16) bis(1-allyl-2,2,6,6-tetramethylpiperidin-4-yl)phthalate
(17) 1-propargyl-4-β-cyanoethyloxy-2,2,6,6-tetramethylpiperidine
(18) 1-acetyl-2,2,6,6-tetramethylpiperidin-4-yl acetate
(19) tris(2,2,6,6-tetramethylpiperidin-4-yl)trimellitate
(20) 1-acryloyl-4-benzyloxy-2,2,6,6-tetramethylpiperidine
(21) bis(2,2,6,6-tetramethylpiperidin-4-yl)diethyl malonate
(22) bis(1,2,2,6,6-pentamethylpiperidin-4-yl)dibutyl malonate
(23) bis(1,2,2,6,6-pentamethylpiperidin-4-yl)butyl-(3,5-di-tert-butyl-4-hydroxybenzyl)malonate
(24) bis(1,2,2,6,6-pentamethylpiperidin-4-yl)dibenzyl malonate
(25) bis(1,2,3,6-tetramethyl-2,6-diethylpiperidin-4-yl)dibenzyl malonate
(26) hexane-1',6'-bis(4-carbamoyloxy-1-n-butyl-2,2,6,6-tetramethylpiperidine)
(27) toluene-2',4'-bis(4-carbamoyloxy-1-n-propyl-2,2,6,6-tetramethylpiperidine)
(28) dimethyl bis(2,2,6,6-tetramethylpiperidin-4-oxy)silane
(29) phenyl tris(2,2,6,6-tetramethylpiperidin-4-oxy)silane
(30) tris(1-propyl-2,2,6,6-tetramethylpiperidin-4-yl)phosphite
(31) tris(1-propyl-2,2,6,6-tetramethylpiperidin-4-yl)phosphate
(32) phenyl[bis(1,2,2,6,6-pentamethylpiperidin-4-yl)]-phosphonate
(33) 4-hydroxy-1,2,2,6,6-pentamethylpiperidine
(34) 4-hydroxy-N-hydroxyethyl-2,2,6,6-tetramethylpiperidine
(35) 4-hydroxy-N-(2-hydroxypropyl)-2,2,6,6-tetramethylpiperidine
(36) 1-glycidyl-4-hydroxy-2,2,6,6-tetramethylpiperidine (b) Compounds of formula (III)

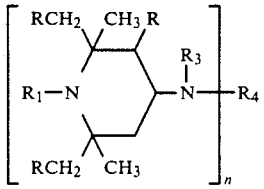

(III)

wherein n is 1 or 2, R and $R_1$ are as defined under (a) (II), $R_3$ is hydrogen, $C_1$–$C_{12}$alkyl, $C_2$–$C_5$hydroxyalkyl, $C_5$–$C_7$cycloalkyl, $C_7$–$C_8$aralkyl, $C_2$–$C_{18}$alkanoyl, $C_3$–$C_5$alkenoyl or benzoyl, and $R_4$, when n is 1, is hydrogen, $C_1$–$C_{18}$alkyl, $C_3$–$C_8$alkenyl, $C_5$–$C_7$cycloalkyl, $C_1$–$C_4$alkyl which is substituted by hydroxy, cyano, alkoxycarbonyl or carbamido, or is glycidyl, a group of formula —$CH_2$—CH(OH)—Z or of formula —CONH—Z, in which Z is hydrogen, methyl or phenyl, or, when n is 2, is $C_2$–$C_{12}$-alkylene, $C_6$–$C_{12}$arylene, xylylene, a —$CH_2$—CH(OH)—$CH_2$— group or a —$CH_2$—CH(OH)—$CH_2$—O—D—O— group, in which D is $C_2$–$C_{10}$alkylene, $C_6$–$C_{15}$arylene or $C_6$–$C_{12}$cycloalkylene, or, provided that $R_3$ is not alkanoyl, alkenoyl or benzoyl, $R_4$ may also be a divalent radical of an aliphatic, cycloaliphatic or aromatic dicarboxylic acid or dicarbamic acid or, in addition, is the group —CO—, or $R_3$ and $R_4$ together, when n is 1, are the divalent radical of an aliphatic, cycloaliphatic or aromatic 1,2- or 1,3-dicarboxylic acid.

Alkyl substituents of 1 to 12 or 1 to 18 carbon atoms are as previously defined under (a).

$C_5$–$C_7$Cycloalkyl is preferably cyclohexyl.

$R_3$ as $C_7$–$C_8$aralkyl is preferably phenylethyl or, most preferably, benzyl. $R_3$ as $C_2$–$C_5$hydroxyalkyl is preferably 2-hydroxyethyl or 2-hydroxypropyl.

$R_3$ as $C_2$–$C_{18}$alkanoyl is, for example, propionyl, butyrl, octanoyl, dodecanoyl, hexadecanoyl, octadecanoyl, but is preferably acetyl, and, as $C_3$–$C_5$-alkenoyl, $R_3$ is preferably acryloyl.

$R_4$ as $C_2$–$C_8$alkenyl is, for example, allyl, methallyl, 2-butenyl, 2-pentenyl, 2-hexenyl or 2-octenyl.

$R_4$ as $C_1$–$C_4$alkyl which is substituted by hydroxy, cyano, alkoxycarbonyl or a carbamido group may be, for example, 2-hydroxyethyl, 2-hydroxypropyl, 2-cyanoethyl, methoxycarbonylmethyl, 2-ethoxycarbonylethyl, 2-amino-carbonylpropyl or 2-(dimethylaminocarbonyl)ethyl.

$C_2$–$C_{12}$Alkylene is, for example, ethylene, propylene, 2,2-dimethylpropylene, tetramethylene, hexamethylene, octamethylene, decamethylene or dodecamethylene.

$C_6$–$C_{15}$Arylene is, for example, o-, m- or p-phenylene, 1,4-naphthylene or 4,4'-diphenylene.

A $C_6$–$C_{12}$cycloalkylene radical D is preferably cyclohexylene.

Examples of polyalkylpiperidine compounds of this class are the following compounds:

(37) N,N'-bis(2,2,6,6-tetramethylpiperidin-4-yl)hexamethylene-1,6-diamine
(38) N,N'-bis(2,2,6,6-tetramethylpiperidin-4-yl)hexamethylene-1,6-diacetamide
(39) 1-acetyl-4-(N-cyclohexylacetamido)-2,2,6,6-tetramethylpiperidine
(40) 4-benzoylamino-2,2,6,6-tetramethylpiperidine
(41) N,N'-bis(2,2,6,6-tetramethylpiperidin-4-yl)-N,N'-dibutyladipamide
(42) N,N'-bis(2,2,6,6-tetramethylpiperidin-4-yl)-N,N'-dicyclohexyl-2-hydroxypropylene-1,3-diamine
(43) N,N'-bis(2,2,6,6-tetramethylpiperidin-4-yl)-p-xylylenediamine
(44) N,N'-bis(2,2,6,6-tetramethylpiperidin-4-yl)succindiamide
(45) bis(2,2,6,6-tetramethylpiperidin-4-yl)-N-(2,2,6,6-tetramethylpiperidin-4-yl)-β-aminodipropionate
(46) the compound of formula

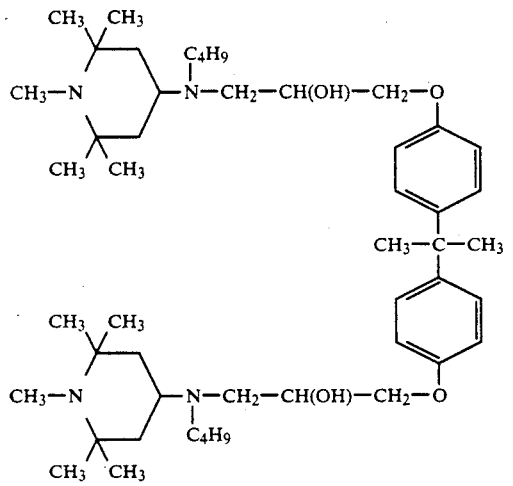

(47) 4-(bis-2-hydroxyethylamino)-1,2,2,6,6-pentamethylpiperidine

(48) 4-(3-methyl-4-hydroxy-5-tert-butylbenzamido)-2,2,6,6-tetramethylpiperidine and

(49) 4-methacrylamido-1,2,2,6,6-pentamethylpiperidine.

(c) Compounds of formula (IV)

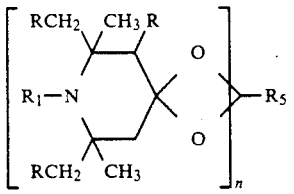

(IV)

wherein n is 1 or 2, R and $R_1$ are as defined under (a) and $R_5$, when n is 1, is $C_2$–$C_8$alkylene or $C_2$–$C_8$hydroxyalkylene or $C_4$–$C_{22}$acyloxyalkylene and, when n is 2, is the group $(—CH_2)_2C(CH_2—)_2$.

$R_5$ as $C_2$–$C_8$alkylene or $C_2$–$C_8$hydroxyalkylene may be ethylene, 1-methylethylene, propylene, 2-ethylpropylene or 2-ethyl-2-hydroxymethylpropylene.

$R_5$ as $C_4$–$C_{22}$acyloxyalkylene may be 2-ethyl-2-acetoxymethylpropylene.

Illustrative of polyalkylpiperidines of this class are the following compounds:

(50) 9-aza-8,8,10,10-tetramethyl-1,5-dioxaspiro[5.5]undecane

(51) 9-aza-8,8,10,10-tetramethyl-3-ethyl-dioxaspiro[5.5]undecane

(52) 9-aza-2,7,7,8,9,9-hexamethyl-1,4-dioxaspiro[4.5]decane

(53) 9-aza-3-hydroxymethyl-3-ethyl-8,8,9,10,10-pentamethyl-1,5-dioxaspiro[5.5]undecane

(54) 9-aza-3-ethyl-3-acetoxymethyl-9-acetyl-8,8,10,10-tetramethyl-1,5-dioxaspiro[5.5]undecane

(55) 2,2,6,6-tetramethylpiperidin-4-spiro-2'-(1',3'-dioxan)-5'-spiro-5''-(1'',3''-dioxane)-2''-spiro-4'''-(2''',2''',6''',6'''-tetramethylpiperidine).

(d) Compounds of formulae VA, VB and VC

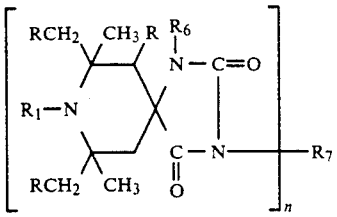

(VA)

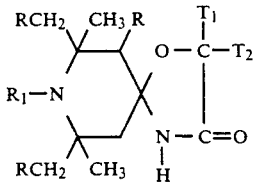

(VB)

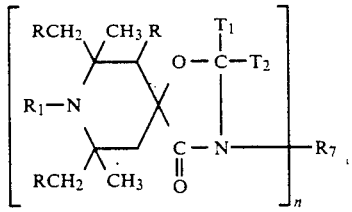

(VC)

wherein n is 1 or 2, R and $R_1$ are as defined under (a), $R_6$ is hydrogen, $C_1$–$C_{12}$alkyl, allyl, benzyl, glycidyl or $C_2$–$C_6$alkoxyalkyl, and $R_7$, when n is 1, is hydrogen, $C_1$–$C_{12}$alkyl, $C_3$–$C_5$alkenyl, $C_7$–$C_9$aralkyl, $C_5$–$C_7$cycloalkyl, $C_2$–$C_4$hydroxyalkyl, $C_2$–$C_6$alkoxyalkyl, $C_6$–$C_{10}$aryl, glycidyl or a group of formula $—(CH_2)_p—COO—Q$ or of formula $—(CH_2)_p—CO—Q$, wherein p is 1 or 2 and Q is $C_1$–$C_4$alkyl or phenyl and, when n is 2, is $C_2$–$C_{12}$alkylene, $C_4$–$C_{12}$alkenylene, $C_6$–$C_{12}$arylene, a group of formula $—CH_2—CH(OH)—CH_2—O—D—O—CH_2—CH(OH)—CH_2—$, wherein D is $C_2$–$C_{10}$alkylene, $C_6$–$C_{15}$arylene, $C_6$–$C_{12}$cycloalkylene, or is a group of formula $—CH_2—CH(OZ')CH_2—(OCH_2—CH(OZ')CH_2)_2—$, wherein Z' is hydrogen, $C_1$–$C_{18}$alkyl, allyl, benzyl, $C_2$–$C_{12}$alkanoyl or benzoyl, $T_1$ and $T_2$ are each independently of the other hydrogen, $C_1$–$C_{18}$alkyl, $C_6$–$C_{10}$aryl or $C_7$–$C_9$aralkyl which may be substituted by halogen or $C_1$–$C_4$alkyl or is $C_7$–$C_9$aralkyl, or $T_1$ and $T_2$, together with the linking carbon atom, form a $C_5$–$C_{12}$cycloalkane ring.

Substituents defined as $C_1$–$C_{12}$alkyl are typically methyl, ethyl, n-propyl, n-butyl, sec-butyl, tert-butyl, n-hexyl, n-octyl, 2-ethylhexyl, n-nonyl, n-decyl, n-undecyl or n-dodecyl.

Substituents defined as $C_1$–$C_{18}$alkyl may be the groups indicated above and, in addition, may be n-tridecyl, n-tetradecyl, n-hexadecyl or n-octadecyl.

Substituents defined as $C_2$–$C_6$alkoxyalkyl may be methoxymethyl, ethoxymethyl, propoxymethyl, tert-butoxymethyl, ethoxyethyl, ethoxypropyl, n-butoxyethyl, tert-butoxyethyl, isopropoxyethyl or propoxypropyl.

$R_7$ as $C_3$–$C_5$alkenyl may be 1-propenyl, allyl, methallyl, 2-butenyl or 2-pentenyl.

$R_7$, $T_1$ and $T_2$ as $C_7$–$C_9$aralkyl may be in particular phenethyl or, preferably, benzyl. Where $T_1$ and $T_2$, together with the linking carbon atom, form a cycloalkane ring, said ring may be a cyclopentane, cyclohexane, cyclooctane or cyclododecane ring.

$R_7$ as $C_2$–$C_4$hydroxyalkyl may be 2-hydroxyethyl, 2-hydroxypropyl, 2-hydroxybutyl or 4-hydroxybutyl.

$R_7$, $T_1$ and $T_2$ as $C_6$–$C_{10}$aryl may be in particular phenyl, α- or β-naphthyl, each unsubstituted or substituted by halogen or $C_1$–$C_4$alkyl.

$R_7$ as $C_2$–$C_{12}$alkylene may be ethylene, propylene, 2,2-dimethylpropylene, tetramethylene, hexamethylene, octamethylene, decamethylene or dodecamethylene.

$R_7$ as $C_4$–$C_{12}$alkenylene is preferably 2-butenylene, 2-pentenylene or 3-hexenylene.

$R_7$ as $C_6$–$C_{12}$arylene may be o-, m- or p-phenylene, 1,4-napthylene or 4,4'-diphenylene.

Z' as $C_2$–$C_{12}$alkanoyl may be propionyl, butyryl, octanoyl, dodecanoyl, but is preferably acetyl.

D as $C_2$–$C_{10}$alkylene, $C_6$–$C_{15}$arylene or $C_6$–$C_{12}$cycloalkylene has the meanings given under (b).

Illustrative of polyalkylpiperdines of this class are the following compounds:

(56) 3-benzyl-1,3,8-triaza-7,7,9,9-tetramethylspiro[4.5]-decane-2,4-dione
(57) 3-n-octyl-1,3,8-triaza-7,7,9,9-tetramethylspiro[4.5]-decane-2,4-dione
(58) 3-allyl-1,3,8-triaza-7,7,9,9-pentamethylspiro[4.5]-decane-2,4-dione
(59) 3-glycidyl-1,3,8-triaza-7,7,9,9-tetramethyl-spiro[4.5]decane-2,4-dione
(60) 1,3,7,7,8,9,9-heptamethyl-1,3,8-triaza-7,7,9,9-tetramethylspiro[4.5]decane-2,4-dione
(61) 2-isopropyl-7,7,9,9-tetramethyl-1-oxa-3,8-diaza-4-oxo-spiro[4.5]decane-2,4-dione
(62) 2,2-dibutyl-7,7,9,9-tetramethyl-1-oxa-3,8-diaza-4-oxo-spiro[4.5]decane-2,4-dione
(63) 2,2,4,4-tetramethyl-7-oxa-3,20-diaza-21-oxo-dispiro[5.1.11.2]-heneicosane
(64) 2-butyl-7,7,9,9-tetramethyl-1-oxa-4,8-diazoa-3-oxo-spiro-[4,5]decane
(65) 8-acetyl-3-dodecyl-1,3,8-triaza-7,7,9,9-tetramethyl-spiro[4,5]-decane-2,4-dione or the compounds of the following formulae

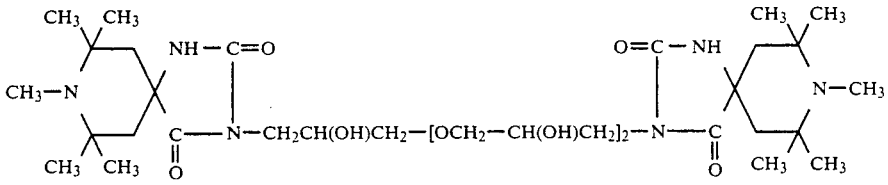
(66)

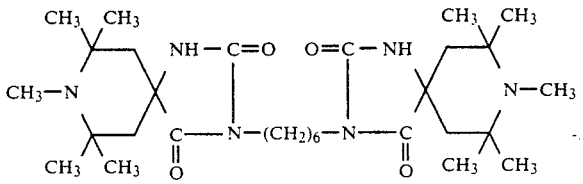
(67)

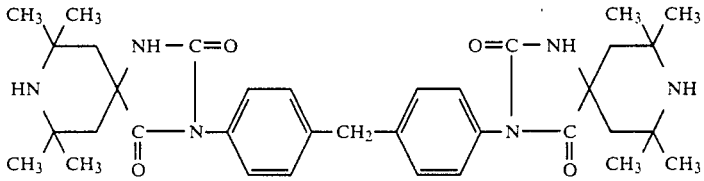
(68)

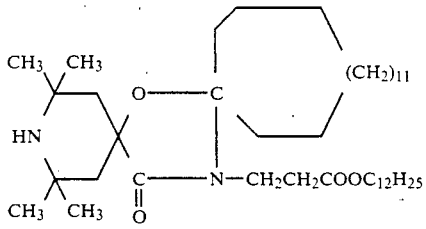
(69)

(e) Compounds of formulae VI

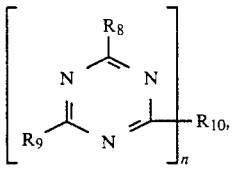
(VI)

wherein n is 1 or 2 and $R_8$ is a group of formula

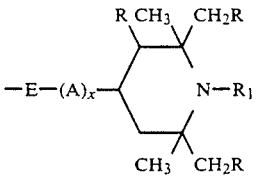

wherein R and $R_1$ are as defined under (a), E is —O— or —$NR_{11}$, A is $C_2$–$C_6$alkylene or —$(CH_2)_3$—O— and x is 0 or 1, $R_9$ has the same meaning as $R_8$ or is a group —$NR_{11}R_{12}$, —$OR_{13}$, —$NHCH_2OR_{13}$ or —$N(CH_2OR_{13})_2$, $R_{10}$, when n is 1, has the same meaning as $R_8$ or $R_9$, and, when n is 2, is a group —E—B—E—, wherein B is $C_2$–$C_6$alkylene which may be interrupted by —N($R_{11}$), $R_{11}$ is $C_1$–$C_{12}$alkyl, cyclohexyl, benzyl or $C_1$–$C_4$hydroxyalkyl or is a group of formula

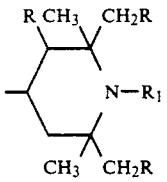

wherein $R_{12}$ is $C_1$–$C_{12}$alkyl, cyclohexyl, benzyl or $C_1$–$C_4$hydroxyalkyl, and $R_{13}$ is hydrogen, $C_1$–$C_{12}$alkyl or phenyl, or $R_{11}$ and $R_{12}$, when taken together, are $C_4$–$C_5$alkylene or $C_4$–$C_5$oxaalkylene, for example

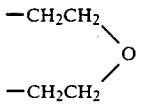

or a group of formula

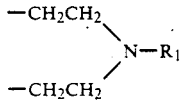

or $R_{11}$ and $R_{12}$ are also each a group of formula

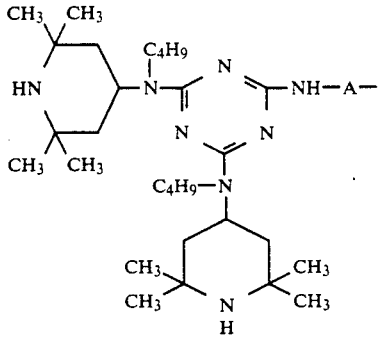

Substituents defined as $C_1$–$C_{12}$alkyl are typically methyl, ethyl, n-propyl, n-butyl, sec-butyl, tert-butyl, n-hexyl, n-octyl, 2-ethylhexyl, n-nonyl, n-decyl, n-undecyl or n-dodecyl.

Substituents defined as $C_1$–$C_4$hydroxyalkyl may be 2-hydroxyethyl, 2-hydroxypropyl, 3-hydroxypropyl, 2-hydroxybutyl or 4-hydroxybutyl.

A as $C_2$–$C_6$alkylene may be ethylene, propylene, 2,2-dimethylpropylene, tetramethylene or hexamethylene.

$R_{11}$ and $R_{12}$, when taken together, as $C_4$–$C_5$alkylene or $C_4$–$C_5$oxaalkylene may be tetramethylene, pentamethylene or 3-oxapentamethylene.

Illustrative of polyalkylpiperidines of this class are the compounds of the following formulae;

(70)

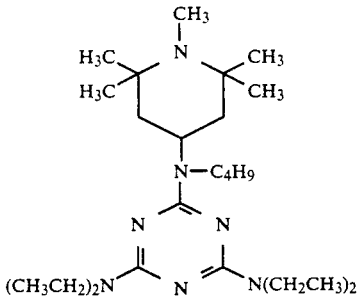

(71)

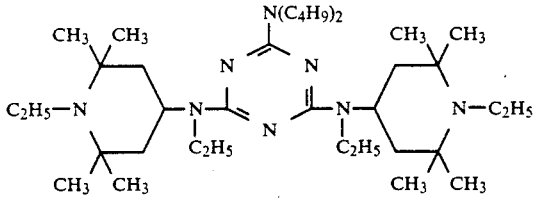

(72)

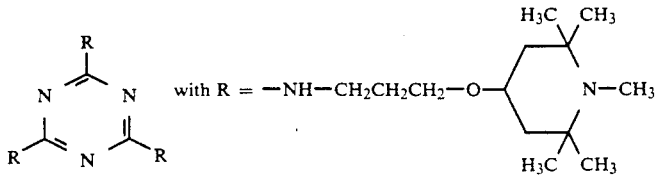

-continued
(73)
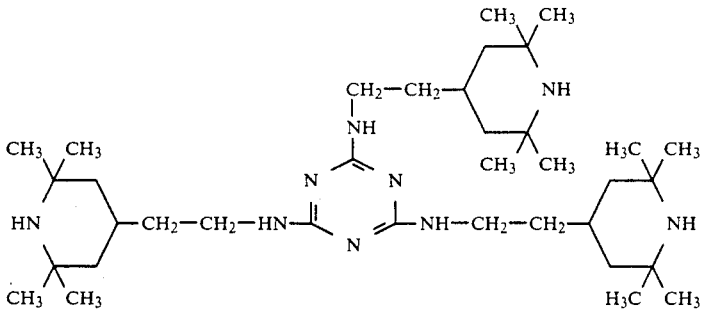
(74)
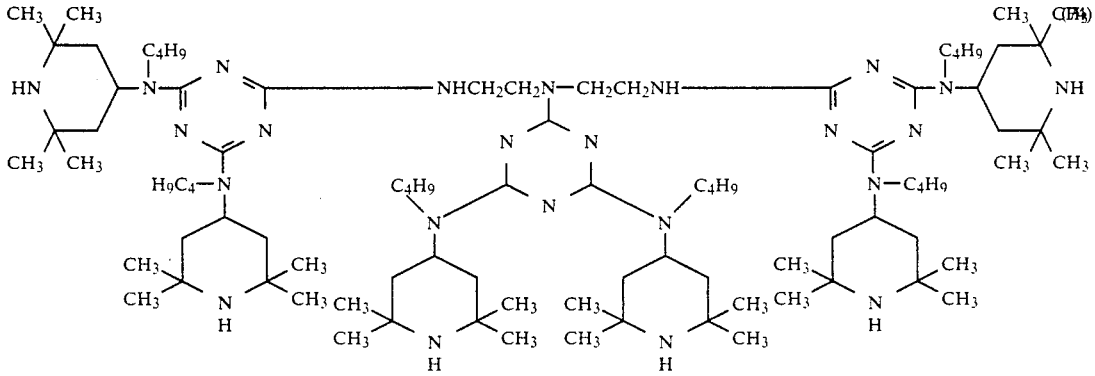
(75)
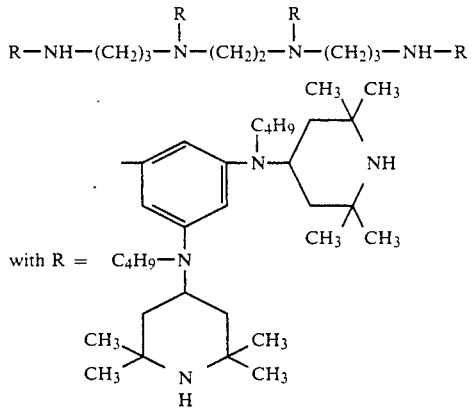
(76)
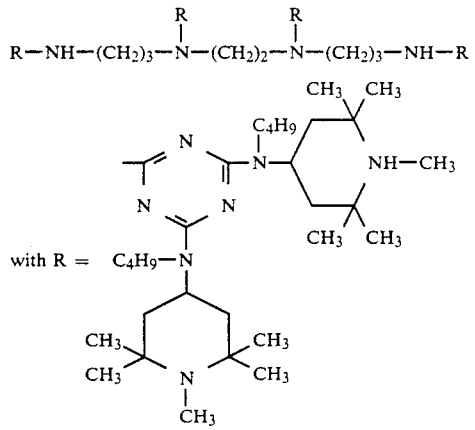
(77)
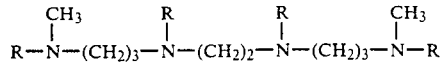

-continued

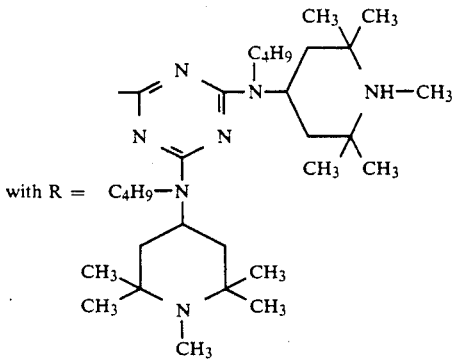

(78)

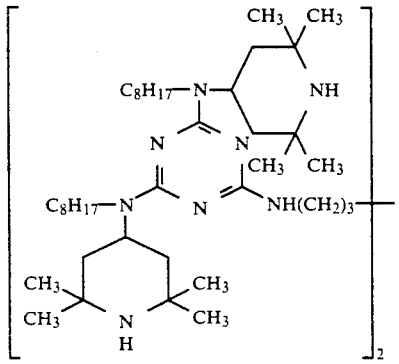

(79)

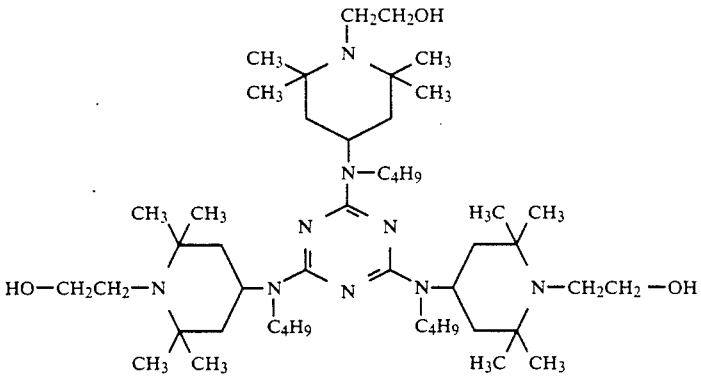

(80)

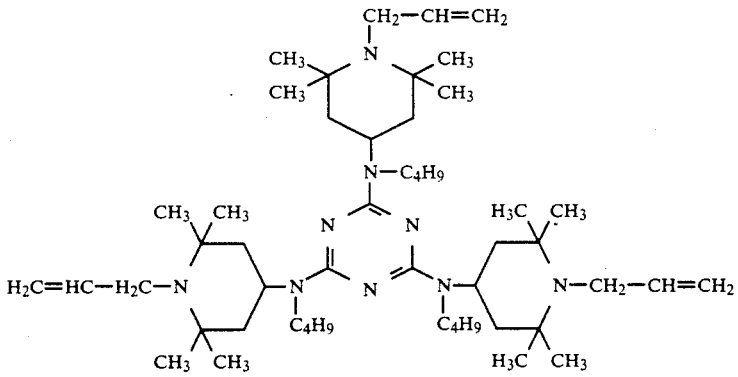

(f) Oligomers or polymers whose recurring structural unit contains a 2,2,6,6-tetraalkylpiperidine radical of formula (I), especially polyesters, polyethers, polyamides, polyamines, polyurethanes, polyureas, polyaminotriazines, poly(meth)acrylates, poly(meth)acrylamides and their copolymers which contain such radicals.

Illustrative of 2,2,6,6-polyalkylpiperidine light stabilisers of this class are the compounds of the following formulae, wherein m is an integer from 2 to ca. 200:

(81)
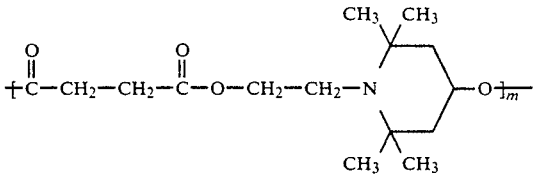
(82)
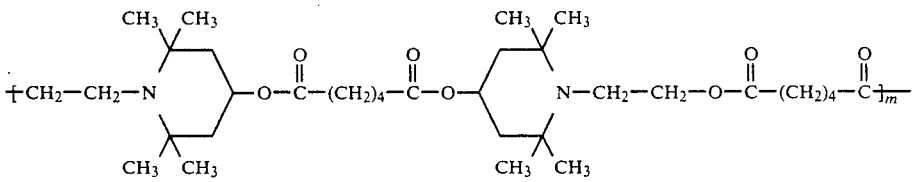
(83)
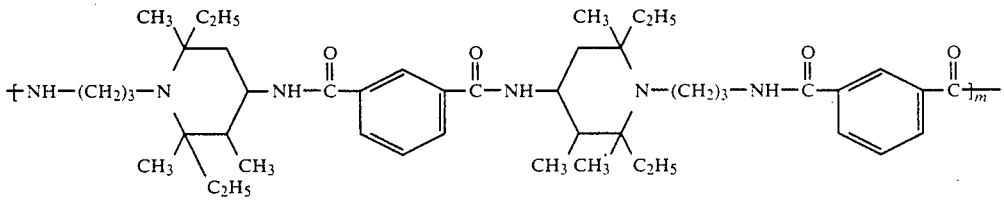
(84)
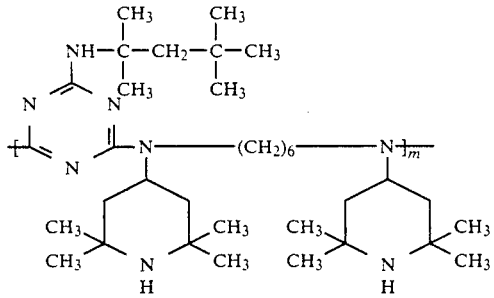
(85)
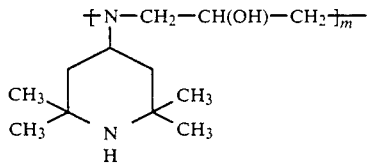
(86)
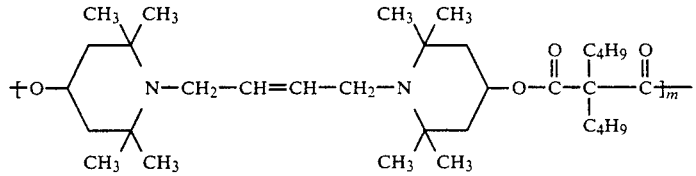
(87)
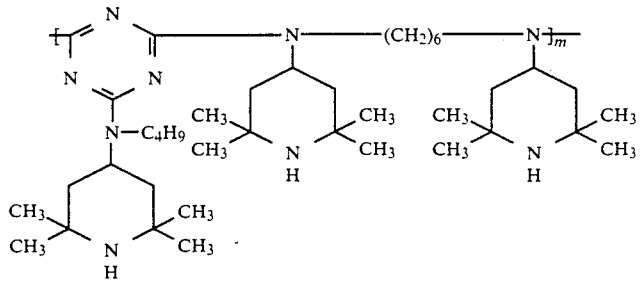

-continued
(88)
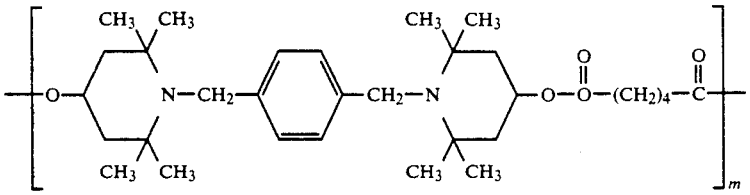
(89)
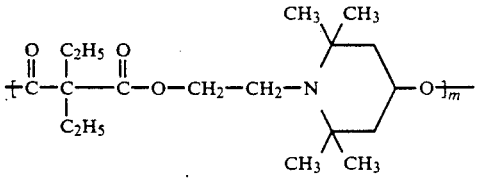
(90)
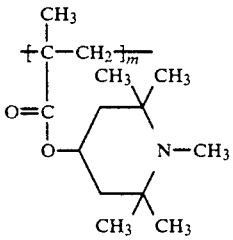
(91)
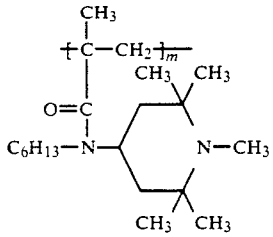
(92)
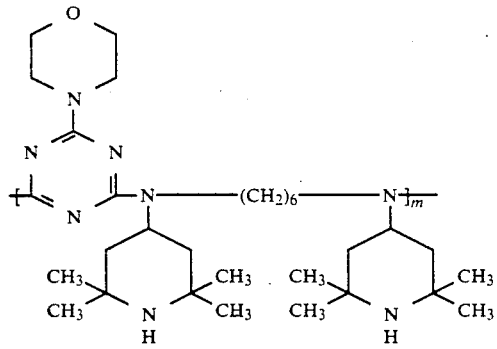
(93)
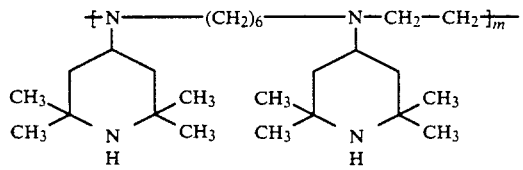
(94)
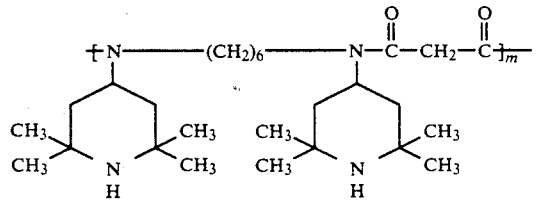
The compounds of formulae (II) are known, for example from U.S. Pat. No. 3,840,494, and can be prepared by the methods disclosed therein. They may be used as the free compounds or in the form of their water-soluble salts. Such salts are suitably salts of organic acids such as carboxylic acids of 1 to 12 carbon atoms, for example formic, acetic, propionic, butyric, valeric, capronic and caprylic acid, or of inorganic polybasic oxygen-containing acids such as sulfuric acid and orthophosphoric acid. Preferred salts are those with formic or acetic acid. Salts of compounds of formula (II), wherein $R_1$ is hydrogen or $C_1$–$C_{12}$alkyl, merit particular interest.

Preferred oligomers are those having a low molecular weight (<700).

The light stabilisers are conveniently used in the form of emulsions or fine dispersions which are obtained by grinding in the presence of nonionic or anionic dispersants.

Suitable nonionic dispersants are adducts of alkylene oxide with alcohols or alkylphenols, e.g. adducts of alkylene oxide with aliphatic $C_4$–$C_{22}$-alcohols, which adducts are obtained by addition of up to 80 mol of ethylene oxide and/or propylene oxide. The alcohols may preferably contain 4 to 18 carbon atoms and be saturated, branched or straight chain. They may be used singly or in admixture with other alcohols. Branched chain alcohols are preferred.

The alcohols may be natural alcohols, for example myristyl alcohol, cetyl alcohol, stearyl alcohol, oleyl alcohol, arachidyl alcohol or behenyl alcohol, or synthetic alcohols, for example preferably butanol, 2-ethyl-1-hexanol, amyl alcohol, n-hexanol, and also triethyl hexanol, trimethyl- nonyl alcohol, or Alfols (registered trademark of the Continental Oil Company). Alfols are linear primary alcohols. The number after the name indicates the average number of carbon atoms contained by the alcohol. For example, Alfol (12–18) is a mixture of decyl, dodecyl, tetradecyl, hexadecyl and octadecyl alcohol. Further examples are Alfol (810), (1014), (12), (16), (18), (2022).

Preferred ethylene oxide/alcohol adducts may be illustrated by the formula $$R_3O(CH_2CH_2O)_sH \qquad (95)$$

wherein $R_3$ is a saturated or unsaturated aliphatic hydrocarbon radical, preferably an alkyl or alkenyl radical, each of 8 to 18 carbon atoms, and s is an integer from 1 to 80, preferably from 1 to 30.

Suitable nonionic dispersants are adducts of ethylene oxide and/or 1,2-propylene oxide and an alkylphenol containing 4 to 12 carbon atoms in the alkyl moiety, which phenol may contain one or more alkyl substituents. Preferably these compounds have the formula

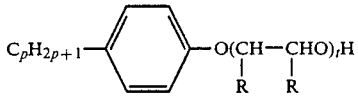

(96)

wherein R is hydrogen or not more than one of the two substituents R is methyl, p is an integer from 4 to 12, preferably 8 or 9, and t is an integer from 1 to 60, preferably from 1 to 20 and, most preferably, from 1 to 6.

If desired, these adducts of ethylene oxide/1,2-propylene oxide with an alcohol or alkylphenol may additionally contain small amounts of block polymers of the cited alkylene oxides.

Further adducts suitable for use as nonionic dispersants are polyoxy- ethylene derivatives of the fatty acid esters of sorbitan ethers with 4 mol of polyethylene glycol, e.g. the laurate, palmitate, stearate, tristearate, oleate and trioleate of the above ethers, e.g. the Tween products of the Atlas Chemicals Division. The tristearate of sorbitan ether with 4 mol of the polyethylene glycol of the formula $$H(CH_2CH_2)_{65}OH$$

is preferred.

Suitable anionic dispersants are esterified adducts of alkylene oxide, for example adducts of alkylene oxide, preferably of ethylene oxide and/or propylene oxide, with organic hydroxyl, carboxyl, amino and/or amido compounds containing aliphatic hydrocarbon radicals having a total of not less than 8 carbon atoms, or mixtures of such compounds, which adducts contain acid ester groups of an inorganic or organic acid. These acid esters may be in the form of the free acids or salts such as alkali metal salts, alkaline earth metal salts, ammonium salts or amine salts.

These anionic surfactants are obtained by known methods, by addition of at least 1 mol, preferably of more than 1 mol, e.g. 2 to 60 mol, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are for example higher fatty alcohols, i.e. alkanols or alkenols, each containing 8 to 22 carbon atoms, alicyclic alcohols, phenylphenols, alkylphenols containing one or more alkyl substituents which together contain at least 10 carbon atoms or fatty acids containing 8 to 22 carbon atoms.

Particularly suitable anionic dispersants are those of formula $$R_1-A-(CH_2\underset{\underset{R_2}{|}}{C}HO)_n-X \qquad (97)$$

wherein $R_1$ is an aliphatic hydrocarbon radical containing 8 to 22 carbon atoms or a cycloaliphatic, aromatic or aliphatic-aromatic hydrocarbon radical containing 10 to 22 carbon atoms, $R_2$ is hydrogen or methyl, A is —O— or $$-\underset{\underset{O}{\|}}{C}-O-,$$

X is the acid radical of an inorganic oxygen-containing acid, the acid radical of a polybasic carboxylic acid or a carboxyalkyl radical, and n is an integer from 1 to 50.

The radical $R_1$—A in the compounds of formula (97) is derived, for example, from higher alcohols such as decyl, lauryl, tridecyl, myristyl, cetyl, stearyl, oleyl, arachidyl or behenyl alcohol; and from alicyclic alcohols such as hydroabietyl alcohol; from fatty acids such as caprylic, capric, lauric, myristic, palmitic, stearic, arachinic, behenic, $C_8$–$C_{18}$coconut fatty, decenoic, dodecenoic, tetradecenoic, hexadecenoic, oleic, linoleic, linolenic, eicosenoic, docosenoic or clupanodonic acid; from alkylphenols such as butylphenol, hexylphenol, n-octylphenol, n-nonylphenol, p-tert-octylphenol, p-tert-nonylphenol, decylphenol, dodecylphenol, tetradecylphenol or hexadecylphenol; or from arylphenols such as the o- or p-phenylphenols. Preferred radicals are those containing 10 to 18 carbon atoms, especially those which are derived from the alkylphenols.

The acid radical X is normally the acid radical of a polybasic, in particular low molecular, mono- or dicarboxylic acid, for example of maleic acid, malonic acid, succinic acid or sulfosuccinic acid, or it is a carboxyalkyl radical, in particular a carboxymethyl radical (derived in particular from chloroacetic acid), and is attached to the radical $R_1—A—(CH_2CHR_1O)_m—$ through an ether or ester bridge. In particular, however, X is derived from an inorganic polybasic acid such as orthophosphoric acid and sulfuric acid. The acid radical X is preferably in salt form, i.e. for example in the form of an alkali metal salt, alkaline earth metal salt, ammonium or amine salt. Examples of such salts are sodium, calcium, ammonium, trimethylamine, ethanolamine, diethanolamine or triethanolamine salts. The alkylene oxide units $-(CH_2CHR_2O)-$ of formula (97) are normally ethylene oxide and 1,2-propylene oxide units. These last mentioned units are preferably in admixture with ethylene oxide units in the compounds of the formula (97).

Particularly interesting anionic compounds are those of formula $$R_3O-(CH_2CH_2O)_nX \quad (98)$$

wherein $R_3$ is a saturated or unsaturated aliphatic hydrocarbon radical containing 8 to 22 carbon atoms, o-phenylphenol or alkylphenol containing 4 to 12 carbon atoms in the alkyl moiety, and X and n have the given meanings.

Especially preferred compounds which are derived from adducts of alkylphenol and ethylene oxide are also those of formulae

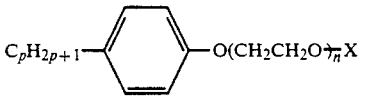
(99)

and

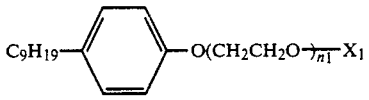
(100)

wherein p is an integer from 4 to 12, n is an integer from 1 to 20, $n_1$ is an integer from 1 to 10, $X_1$ is a sulfuric acid radical or a phosphoric acid radical which can be in salt form, and X has the given meaning.

Further suitable dispersants are, for example, the known ligninsulfonates, condensates of naphthalenesulfonic acid and/or naphthol- or naphthylaminesulfonic acids with formaldehyde, condensates of phenolsulfonic acids and/or phenols with formaldehyde and urea.

Particularly suitable dispersants are also sulfonated condensates which have been obtained by reacting, in any order, an aromatic compound containing at least two replaceable hydrogen atoms in the nucleus with a compound of formula

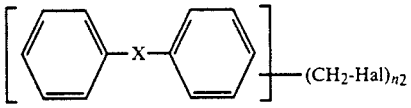
(101)

wherein X is a direct bond or oxygen, Hal is chloro or bromo, and $n_2$ is 1 to 4, and sulfonating the reaction product so obtained.

These sulfonated condensates preferably have the formula

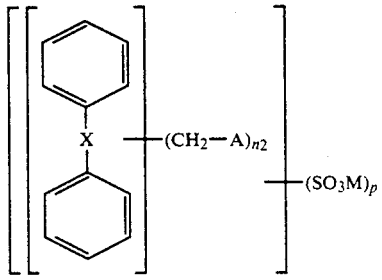
(102)

wherein X is a direct bond or oxygen, A is the radical of an aromatic compound which is attached by a ring carbon atom to the methylene group, M is hydrogen or a cation, for example alkali metal, alkaline earth metal, or the ammonium group, and $n_2$ and p are each an integer from 1 to 4. Preferably $n_2$ and p are 1 or 2, or they may also each be any fraction from 1 to 4, for example 1.4, 1.8, 2.1 or 3.2.

Preferred starting materials of formula (101) are chloromethyl diphenyl and chloromethyl diphenyl ether. These compounds are normally mixtures of isomers containing 1 to 3 chloromethyl groups, which chloromethyl groups are preferably in o-and p-position of both benzene rings. Hence the corresponding sulfonated condensates are also normally obtained as mixtures, especially of mono- to trisubstituted diphenyl or diphenyl ether products. Depending on the starting materials and the chosen reaction conditions during the synthesis of the condensates, the ratio of the isomers to one another changes. When $n_2$ is 1, p-isomers are obtained in amounts of typically 30 to 90%, and o-isomers in amounts of typically 70 to 10%. When $n_2$ is 2, the compounds obtained are typically p,p'-, o,o' or o,p'-isomers.

These sulfonated condensates and the preparation thereof are disclosed in German Offenlegungsschrift 2 353 691. Further details concerning them may be gleaned from this publication.

Typical examples of the emulsifiers used are ethoxylated waxes or fatty alcohols which may be completely or partially esterified with fatty acids, polyalcohols or, preferably, alkoxylated polyalcohols (for example glycol, diglycol, alkylene or dialkylene glycols, sorbitan, sorbitol, mannitol, xylitol, pentaerythritol, diglycerol, glycerol and glyceryl sorbitol) which are completely or partially esterified with fatty acids; ethoxylated sugar derivatives (for example saccharose or glucose derivatives) which may be esterified with fatty acids; phosphoric acid esters (mono-, di- and triesters and mixtures thereof) of waxes or fatty alcohols or of ethoxylated waxes or fatty alcohols; and fatty acid monoalkanolamides or dialkanolamides. The wax or fatty alcohol starting materials of the emulsifiers used in the practice of this invention are suitably stearyl, oleyl, cetyl, lanolin, wool fat or wool wax alcohol, and the fatty acids are suitably myristic, palmitic, stearic, isostearic, oleic, linoleic, linolenic or lanolinic acid. Also suitable are natural substances (for example zoosterols or phytosterols), cationic emulsifiers and hydrotropic solubilisers (for example polyalcohol/polyglycol ether polyethoxylated fatty acids) as well as polyadducts of fatty or wax alcohols and ca. 10 to 30 mol of ethylene oxide and/or propylene oxide.

The application of the dispersed or emulsified light stabiliser may be made before, during or after dyeing, by an exhaust process and at a liquor to goods ratio of 1:5 to 1:200, preferably 1:10 to 1:50, for example in a circulation dyeing machine or winch beck. The artificial leather may also be stabilised by an aftertreatment by adding the light stabiliser immediately after the dyeing process to the exhausted dyebath in the dye liquor.

The light stabiliser can, however, also be applied continuously by a low loading or hot application system.

The present invention also relates to a composition for carrying out the process described herein, which comprises (a) 5 to 90% by weight of a light stabiliser,
(b) 0 to 50% by weight of a dispersant,
(c) 0 to 50% by weight of an emulsifier, and water and/or an organic solvent to make up 100%, with the proviso that one of components (b) or (c) is always present in the composition.

Conveniently the composition of this invention comprises (a) 50 to 70% by weight of a light stabiliser,
(b) 0 to 25% by weight of a dispersant,
(c) 0 to 40% by weight of an emulsifier, and water and/or an organic solvent to make up 100%, with the proviso that one of components (b) or (c) is always present in the composition.

The composition may also contain further ingredients such as stabilisers, UV absorbers, diluents or emulsion matrices.

The artificial leather which is photochemically stabilised will be understood as meaning the synthetic bonded fibre webs described, for example, in Textiltechnik 37(2), page 118, (1987).

It is also possible to use artificial leather which has been whitened prior to the treatment with the light stabiliser.

Artifical leather containing carbon black pigments in the web are also used.

The process of this invention is especially suitable for the photochemical stabilisation of artifical leather which, to a high degree, is exposed to the effects of light and heat and which is used, for example, in automobile interiors.

Dyeing is carried out in conventional manner, for example with metal complex dyes or with anthraquinone or azo dyes. The metal complex dyes used are the known types, especially the 1:2 chromium or 1:2 cobalt complexes of monoazo, disazo or azomethine dyes which are described extensively in the literature. Besides these dyes, dyes belonging to other classes may of course also be suitably used, for example disperse or also vat dyes.

The invention is illustrated by the following Examples, in which parts and percentages are by weight. Unless otherwise indicated, the percentages relating to the ingredients of the individual treatment and dye baths refer to the material of the artifical leather.

EXAMPLE 1

Two 10 g pieces of a polyamide/polyurethane fibre web (60:40, for example ®Amaretta) are dyed at a liquor to goods ratio of 1:20 in a bath which contains 0.25 g/l of monosodium phosphate, 1.75 g/l of disodium phosphate (≙pH 7.25) as well as the following dyes:

2.5 g of the dye of formula

I

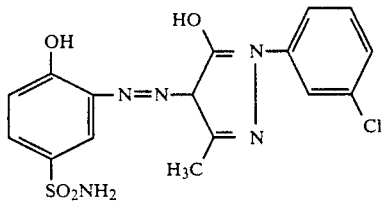

1:2 Co complex 0.22 g of the dye of formula

II

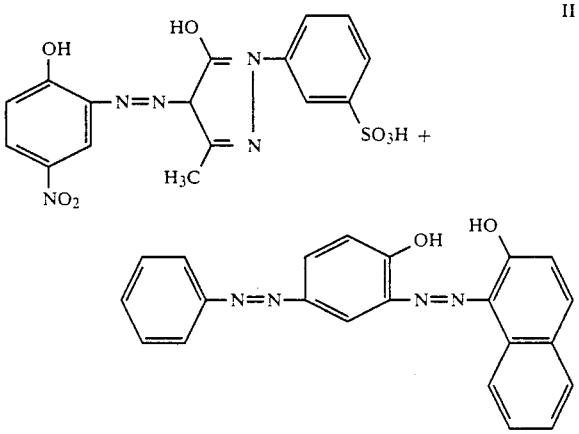

(1:1 Cr complex)

0.15 g of the dye of formula

III

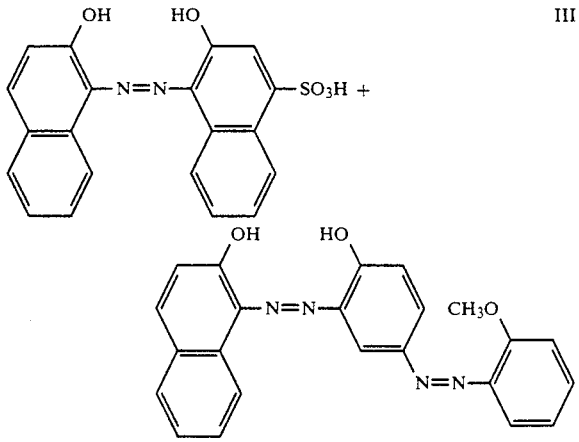

1:2 Cr complex

Dyeing is carried out in a HT dyeing machine by putting the goods in at 50° C., heating at a rate of 2° C./min to 110° C. and dyeing for 30 minutes at this temperature. Fibre web 1 is rinsed with cold water and dried (dyeing 1). Fibre web 2 is aftertreated in a liquor which contains the following ingredients:

1 g/l of sodium carbonate 1.5% of a formulation of the following composition:

65 parts of the compound of formula

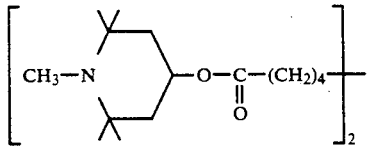

(103)

20 parts of a linear $C_{10}$–$C_{13}$alkylbenzene 15 parts of an adduct of nonylphenol and 9.5 parts of ethylene oxide.

The formulated compound (103) is emulsified into the treatement liquor. Treatment is carried out for 30 minutes at a temperature of 70° C., and the goods are then rinsed and dried (dyeing 2).

The beige dyeings obtained on the two fibre webs are tested for their fastness to hot light and the results are as follows:

| | Lightfastness according to DIN 75.202 |
|---|---|
| DYEING 1 | −4 |
| DYEING 2 | −6 |

EXAMPLE 2

The procedure of Example 1 is repeated. The aftertreatment of dyeing 2, however, is carried out at 70° C. and for 30 minutes in a liquor (liquor ratio 1:20) which contains the following ingredients:

1 g/l of sodium carbonate 1.0% of the compound

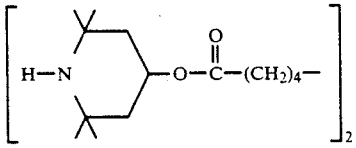

(104)

as 30% dispersion, 0.5 g/l of the adduct of 1 mol of phosphated nonylphenol and 10 ml of ethylene oxide.

Before use, compound (104) is ground with quartz beads to a particle size of less than 2 μm. The dispersant used is the sodium salt of the condensate of ditolyl ether sulfonic acid with formaldehyde, which is added in the ratio 2:1 (product:dispersant).

The dyeings are tested for their fastness to hot light, and the results are as follows:

| | Lightfastness according to DIN 75.202 |
|---|---|
| DYEING 1 | −4 |
| DYEING 2 | 6 |

EXAMPLE 3

The procedure of Example 1 is repeated, except that three 10 g samples are dyed with the following dyes:

1.75% of the dye of formula I 0.15% of the dye of formula II 0.10% of the dye of formula III 5.4% of the dye of the constitution number C.I. 12 770

0.67% of the dye of formula

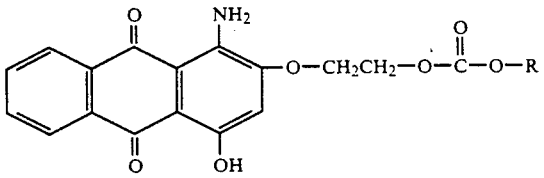

IV

R=50% —$CH_2CH_3$

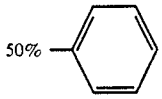

0.16% of the dye of formula

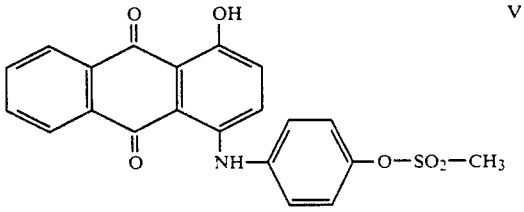

V 0.16% of the dye of formula

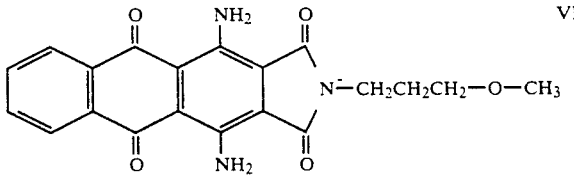

VI

Sample 1 is not aftertreated. Sample 2 is aftertreated with compound (103) and sample 3 with compound (104). The fastness to hot light of the dyeings is as follows:

| | Lightfastness according to DIN 75.202 |
|---|---|
| DYEING 1 | 3–4 |
| DYEING 2 | 6–7+ |
| DYEING 3 | 6–7 |

EXAMPLE 4

Two 10 g samples are prepared (series 1 and 2) from polyamide/polyurethane fibre webs of each of the colours natural white, grey and dark grey (®Amaretta, available from Kuraray, Japan). (The grey pigmentation of the fibre webs is carried out in order to save dye in numerous opaque shades). All samples are dyed separately at a liquor ratio of 1:20 in a bath which contains 1% of ammonium sulfate (pH 6.5) and the following dyes:

1.6% of the dye of formula

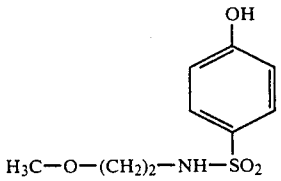

VII 0.6% of the dye of formula I.

Dyeing is carried out as in Example 1. The samples of series 1 are rinsed and dried; but those of series 2, as in Example 1, are aftertreated and finished.

Both treated series are tested for their lightfastness properties in accordance with SN-ISO 105-B02 (xenon light test) and DIN 75 202 (Fakra). The following results are obtained:

| Dyeing on | COLOUR | *LIGHTFASTNESS xenon | Fakra 1x | Fakra 2x |
|---|---|---|---|---|
| Series 1 (without aftertreatment) | | | | |
| natural white web | "brick" | 4 | −2 H | 1-2 H |
| grey web | "nougat" | 6-7 | 3-4 GT | 3 GT |
| dark grey web | dark brown | 6-7 | 4 | 3-4 T |
| Series 2 (with aftertreatment) | | | | |
| natural white web | "brick" | 6 | 3-4 GH | −3 GH |
| grey web | "nougat" | 7 | 4 | 3-4 T |
| dark grey web | dark brown | 7 | 4-5 | 4 |

*Note:
xenon light: against blue scale
Fakra light: against grey scale
Fakra 1x = 1 test cycle, Fakra 2x = 2 test cycles It is evident that the application of compound (103) imparts to the dyeings markedly better lightfastness properties.

EXAMPLE 5

Five 10 g samples of a polyamide/polyurethane fibre web (for example ®Amaretta) are prepared and dyed according to Example 1 with the following dyes:

| | |
|---|---|
| 5.0% of the dye of formula VII<br>0.6% of the dye of formula I<br>1.8% of the dye of formula III | claret |

The dyeings are rinsed and dried.

Dyeing 1 remains unchanged, whereas the other are aftertreated separately for 30 minutes at 80° C. in liquors of the following composition:

0.5 g/l of sodium carbonate 0.5 g/l of the adduct of 1 mol of phosphated nonylphenol and 10 mol of ethylene oxide as well as 1% of each of the compounds of formulae (103) to (106).

Compound of formula (103): see Example 1

Compound of formula (104): see Example 2

Compound of formula (105):

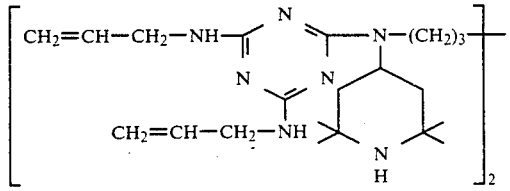

Compound of formula (106):

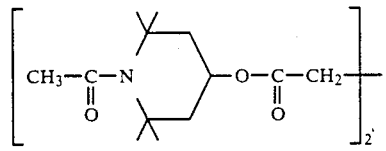

The compounds of formulae (105) and (106) are used as 30% dispersion with the condensate of sulfonated naphthalene and formaldehyde.

Samples 1-5 are tested for their lightfastness properties in accordance with SN-ISO 105-B02 and DIN 75 202, and the results are as follows:

| Dyeing/Treatment | LIGHTFASTNESS according to xenon | Fakra |
|---|---|---|
| only dyeing | 4-5 | −2 |
| + treatment with the compound of formula (103) | 6 | 3 |
| + treatment with the compound of formula (104) | 6 | 3 |
| + treatment with the compound of formula (105) | 5-6 | −3 |
| + treatment with the compound of formula (106) | 5-6 | −3 |

EXAMPLE 6

Two 10 g polyamide/polyurethane fibre webs are dyed according to Example 1, except that dyeing 1 is cooled to room temperature, rinsed and dried at the end of the dyeing process, whereas the liquor of dyeing 2 is solely cooled to 80° C. and 1% of the compound of formula (104) is added as 30% dispersion. After a treatment time of 30 minutes, this dyeing too is finished.

The test of the lightfastness properties in accordance with DIN 75 202 shows a marked improvement of the lightfastness of the sample additionally treated with the compound of formula (104).

What is claimed is:

1. A process for the photochemical stabilization of an undyed and dyeable artificial leather web of bonded synthetic polyamide/polyurethane fibers, comprising the step of applying to the web an aqueous liquor which contains a light stabilizer of the formula:

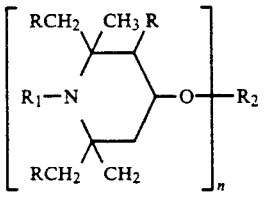

or a water-soluble salt thereof, wherein n is an integer from 1 to 4, R is hydrogen or methyl, $R_1$ is hydrogen, hydroxy, $C_1$-$C_{12}$alkyl, $C_3$-$C_8$alkenyl, $C_3$-$C_8$alkynyl, $C_7$-$C_{12}$aralkyl, $C_1$-$C_8$alkanoyl, $C_3$-$C_5$alkenoyl, glycidyl, —O—$C_1$-$C_{12}$alkyl, —O—$C_1$-$C_8$alkanoyl or a group —$CH_2CH(OH)$—Z, wherein Z is hydrogen, methyl or phenyl, and $R_2$, when n is 1, hydrogen, $C_1$-$C_{18}$alkyl which may be interrupted in the chain by one or more oxygen atoms, or is cyanoethyl, benzyl, glycidyl, a monovalent radical of an aliphatic, cycloaliphatic, araliphatic or aromatic carboxylic acid, carbamic acid or phosphorus-containing acid, or is a monovalent silyl radical or, when n is 2, $C_1$-$C_{12}$alkylene, $C_4$-$C_{12}$alkenylene, xylylene, a divalent radical of an aliphatic, cycloaliphatic, araliphatic or aromatic dicarboxylic acid, dicarbamic acid or phosphorus-containing acid, or is a divalent silyl radical, or, when n is 3, a trivalent radical of an aliphatic, cycloaliphatic or aromatic tricarboxylic acid, of an aromatic tricarbamic acid or of a phosphorus-containing acid, or is a trivalent silyl radical or, when n is 4, a tetravalent radical of an aliphatic, cycloaliphatic or aromatic tetracarboxylic acid.

2. The process of claim 1 wherein n is 1 or 2, R is hydrogen, $R_1$ is hydrogen or $C_1$-$C_4$alkyl, and $R_2$, when n is 1, a monovalent radical of an aliphatic carboxylic acid of 8 to 10 carbon atoms and, when n is 2, a divalent radical of an aliphatic dicarboxylic acid of 6 to 10 carbon atoms.

3. The process of claim 1 wherein the aqueous liquor contains a mixture of compounds wherein n is 1 or 2.

4. The process of claim 1 wherein the stabilizer is in the form of a salt with an oxygen-containing acid.

5. The process of claim 4 wherein $R_1$ is hydrogen or $C_1$-$C_{12}$alkyl.

6. The process of claim 1 wherein the application of the aqueous liquor which contains the light stabilizer is associated with a dyeing process.

7. The process of claim 6 wherein the application of the aqueous liquor which contains the light stabilizer is carried out after the dyeing process.

8. The process of claim 6 wherein the light stabilizer is applied by addition to the exhausted dye liquor.

9. The process of claim 1 wherein the application is carried out discontinuously by an exhaust process.

10. The process of claim 1 wherein the web contains a carbon black pigment.

11. The process of claim 1 wherein $R_1$ is hydrogen, $C_1$-$C_4$alkyl, allyl, benzyl, acetyl or acryloyl.

12. The process of claim 1 wherein n is 1 or 2.

13. The process of claim 1, where $R_2$, when n is 1, a radical of an aliphatic carboxylic acid of 2 to 18 carbon atoms, of a cycloaliphatic carboxylic acid of 7 to 15 carbon atoms, of an, -unsaturated carboxylic acid of 3 to 5 carbon atoms or of an aromatic carboxylic acid of 7 to 15 carbon atoms, or, when n is 2, a radical of an aliphatic dicarboxylic acid of 2 to 36 carbon atoms, of a cycloaliphatic or aromatic dicarboxylic acid of 8 to 14 carbon atoms, or of an aliphatic, cycloaliphatic or aromatic dicarbamic acid of 8 to 14 carbon atoms.

14. A composition for the photochemical stabilization of an undyed and dyeable artificial leather web of bonded synthetic polyamide/polyurethane fibers, comprising (a) 5 to 90% by weight of a light stabilizer of the formula:

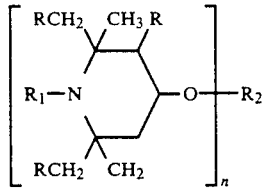

or a water-soluble salt thereof, wherein n is an integer from 1 to 4, R is hydrogen or methyl, $R_1$ is hydrogen, hydroxy, $C_1$-$C_{12}$alkyl, $C_3$-$C_8$alkenyl, $C_3$-$C_8$alkynyl, $C_7$-$C_{12}$aralkyl, $C_1$-$C_8$alkanoyl, $C_3$-$C_5$alkenoyl, glycidyl, —O—$C_1$-$C_{12}$alkyl, —O—$C_8$alkanoyl or a group —$CH_2CH_2CH(OH)$—Z, wherein Z is hydrogen, methyl or phenyl, and $R_2$, when n is 1, hydrogen, $C_1$-$C_{18}$alkyl which may be interrupted in the chain by one or more oxygen atoms, or is cyanoethyl, benzyl, glycidyl, a monovalent radical of an aliphatic, cycloaliphatic, araliphatic or aromatic carboxylic acid, carbamic acid or phosphorus-containing acid, or is a monovalent silyl radical or, when n is 2, $C_1$-$C_{12}$alkylene, $C_4C_{12}$alkenylene, xylylene, a divalent radical of an aliphatic, cycloaliphatic, araliphatic or aromatic dicarboxylic acid, dicarbamic acid or phosphorus-containing acid, or is a divalent silyl radical, or, when n is 3, a trivalent radical of an aliphatic, cycloaliphatic or aromatic tricarboxylic acid, of an aromatic tricarbamic acid or of a phosphorus-containing acid, or is a trivalent silyl radical or, when n is 4, a tetravalent radical of an aliphatic, cycloaliphatic or aromatic tetracarboxylic acid, (b) 0 to 50% by weight of a dispersant, (c) 0 to 50% by weight of an emulsifier, and (d) water, an organic solvent, or both to make up 100%.

15. An artificial leather web of bonded synthetic polyamide/polyurethane fibers treated by a process comprising the step of applying to the web an aqueous liquor which contains a light stabilizer of the formula:

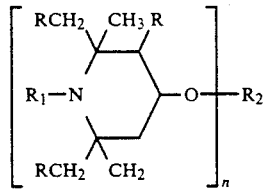

or a water-soluble salt thereof, wherein n is an integer from 1 to 4, R is hydrogen or methyl, $R_1$ is hydrogen, hydroxy, $C_1$-$C_{12}$alkyl, $C_3$-$C_8$alkenyl, $C_3$-$C_8$alkynyl, $C_7$-$C_{12}$aralkyl, $C_1$-$C_8$alkanoyl, $C_3$-$C_5$alkenoyl, glycidyl, —O—$C_1$-$C_{12}$alkyl, —O—$C_1$-$C_8$alkanoyl or a group —$CH_2CH(OH)$—Z, wherein Z is hydrogen, methyl or phenyl, and $R_2$, when n is 1, hydrogen, $C_1$-$C_{18}$alkyl which may be interrupted in the chain by one or more oxygen atoms, or is cyanoethyl, benzyl, glycidyl, a monovalent radical of an aliphatic, cycloaliphatic, araliphatic or aromatic carboxylic acid, carbamic acid or phosphorus-containing acid, or is a monovalent silyl radical or, when n is 2, $C_1$–$C_{12}$alkylene, $C_4$–$C_{12}$alkenylene, xylylene, a divalent radical of an aliphatic, cycloaliphatic, araliphatic or aromatic dicarboxylic acid, dicarbamic acid or phosphorus-containing acid, or is a divalent silyl radical, or, when n is 3, a trivalent radical of an aliphatic, cycloaliphatic or aromatic tricarboxylic acid, of an aromatic tricarbamic acid or of a phosphorus-containing acid, or is a trivalent silyl radical or, when n is 4, a tetravalent radical of an aliphatic, cycloaliphatic or aromatic tetracarboxylic acid.

* * * * *